US006086738A

United States Patent [19]

Mouri et al.

[11] Patent Number: 6,086,738

[45] **Date of Patent: *Jul. 11, 2000**

[54] RECORD SHEET USED IN ELECTRO-COAGULATION PRINTING METHOD

[75] Inventors: Toyohisa Mouri, Shizuoka; Toshio Takagi, Tokyo; Shigeki Matsunaga; Yutaka Hattori, both of Shizuoka, all of Japan

[73] Assignee: Tokusho Paper Mfg. Co. Ltd., Shizuoka, Japan

[ * ] Notice: This patent is subject to a terminal disclaimer.

[21] Appl. No.: 09/222,532

[22] Filed: Dec. 29, 1998

Related U.S. Application Data

[63] Continuation of application No. 08/756,398, Nov. 27, 1996, Pat. No. 5,888,367.

[30] Foreign Application Priority Data

Nov. 29, 1995 [JP] Japan ..... 7-310336
Sep. 4, 1996 [JP] Japan ..... 8-234097

[51] Int. Cl.[7] ..... B41M 5/20; C25D 13/04; C25D 13/16

[52] U.S. Cl. ..... 204/483; 204/476; 204/492; 204/623; 204/624; 101/489; 101/465; 101/466

[58] Field of Search ..... 204/623, 624, 204/483, 486, 489, 442, 476, 493, 508; 101/465, 466, 489, DIG. 37

[56] References Cited

U.S. PATENT DOCUMENTS 4,661,222 4/1987 Castegnier ..... 204/483

*Primary Examiner*—Jill Warden
*Assistant Examiner*—John S. Starsiak, Jr.
*Attorney, Agent, or Firm*—Pitney, Hardin, Kipp & Szuch LLP

[57] ABSTRACT

The present invention provides a record sheet used in an electro-coagulation printing method for forming characters and images on a cylinder as an electrode with an ink which coagulates with electric charge and for transferring the characters and images to the record sheet, wherein the wet time is 15 milliseconds or less, obtained from the absorption curve of pure water measured by a dynamic scanning absorptometer. Preferably, the record sheet has 5 $ml/m^2 s^{-1/2}$ or more absorption coefficient, and more preferably, has contact ratio measured by a specular reflection smoothness tester under a pressure of 40 $kg/cm^2$ with a ray having a wavelength of 0.5 $\mu m$ is 40% or more. The record sheet can be used for various print sheets, in particular, for business form sheets and newspaper sheets.

12 Claims, 2 Drawing Sheets

RECORD SHEET USED IN ELECTRO-COAGULATION PRINTING METHOD

CROSS REFERENCE TO RELATED APPLICATIONS

This is a continuation of U.S. patent application Ser. No. 08/756,398, filed Nov. 27, 1996, now U.S. Pat. No. 5,888,367.

BACKGROUND OF THE INVENTION

1. Field

The present invention relates to a record sheet used in the electro-coagulation printing method for forming an ink layer representing an image of desired characters, pictures, and so forth on a cylinder which constitutes an electrode using an ink which coagulates with electric charge, in particular, to a record sheet for allowing characters and images to be formed with high quality.

2. Prior art

The electro-coagulation printing method has been well known as disclosed in, for example, U.S. Pat. Nos. 3,892,645, 4,555,320 and U.S. Pat. No. 4,764,264, and JPA Hei 4-504688. An ink used in the electro-coagulation printing method is water ink. The water ink is composed of water, a polymer which electrolytically coagulates, a soluble electrolyte, and coloring agent. Examples of the polymer which electrolytically coagulates are albumin, gelatine, casein, agar, polyacrylate, polyacrylamide, and PVA. Examples of the soluble electrolyte are lithium chloride, sodium chloride, calcium chloride, potassium chloride, nickel chloride, copper chloride, and magnesium sulfate.

The electro-coagulation process is basically performed in the following manner. In the state that the above-described ink layer is present between a positive electrode and an negative electrode, when an electric potential is produced therebetween, colloid coagulates and adheres to the positive electrode. The coagulation takes place in the state that the colloid is colored with a coloring agent contained in the ink. By arranging the colored coagulated colloid in a pattern corresponding to a desired image, the desired image can be reproduced. By transferring the reproduced image to a record sheet by a proper method, the desired image is recorded on the record sheet.

The structure of a printer according to the electro-coagulation printing method is described in the above-mentioned JPA Hei 4-504688. Referring to FIG. 1, the structure of the main part of a conventional printer according to the electro-coagulation printing method will be described in brief. FIG. 1 is a schematic diagram showing a structure of a printer for forming an image of a monochrome picture and transferring the image to a record sheet. When an image with a multiple colors is printed, a desired number of the same units are used corresponding to the number of the desired colors. In FIG. 1, reference numeral 1 depicts a metal cylinder which functions as a positive electrode. The metal cylinder is composed of a metal which is electrically inactive such as stainless steel. Two cylindrical electrodes 2 are independently disposed on the periphery of the positive electrode 1. The cylindrical electrodes 2 are insulated from the electrode 1. An amount of ink sprayed from an ink spraying device 3 is filled in a nip between the electrodes 1 and 2. The positive electrode 1 is continuously rotated in the clockwise direction in FIG. 1. With a potential difference between the positive electrode 1 and the negative electrodes 2, coagulated colloid portions and non-coagulated portions are formed in the ink filled between the positive electrode 1 and the negative electrodes 2. The coagulated colloid adheres to the positive electrode 1. Only the non-coagulated portion is selectively removed from the positive electrode by a wiper 4 or the like.

A press roll 5 is pressed against the periphery of the positive electrode 1. A record sheet 6 is traveled by the positive electrode 1 and the press roll 5. Thus, the coagulated colloid held on the periphery of the press roll 5 is placed in the position of the press roll 5 as the positive electrode 1 rotates. The coagulated colloid is contacted and transferred to the record sheet 6. At this point, the nip pressure between the press roll 5 and the positive electrode 1 is in the range from 30 to 50 kg/cm. After the coagulated colloid is transferred to the record sheet, the positive electrode 1 is further rotated, and then cleaned by a cleaning device 7. Thereafter, a corrosion resisting agent is coated on the periphery of the positive electrode by a corrosion resisting agent coating device 8. Thus, one cycle of the printing process has been completed.

When compared with the conventional printing methods such as offset printing method, letterpress printing method, screen printing method, and gravure printing method, as a major difference, the electro-coagulation printing method is categorized as so-called "non-plate printing method." The non-plate printing method has many advantages over the conventional printing methods. In the conventional printing methods, a step for forming a printing plate is essential. The cost for the printing plate per one print sheet is usually very large. On the other hand, since the non-plate printing method does not need the printing plate forming step, the cost is greatly reduced. In addition, in the case of the conventional "plate printing method," although the step for printing the same prints can be performed at high speed, it takes a long time to replace the plates. In contrast, in the "non-plate printing method," data is received from a computer is read and printed. Thus, the preparing time for different prints is very short. Consequently, it can be considered that the electro-coagulation printing method is much superior to the conventional printing methods particularly in a small lot printing.

In addition, since the preparing time for printing different prints is very short, so-called page variable process where the base text of direct mails and individual addresses are printed, which is impossible in the conventional printing methods, can be performed.

Moreover, the printer using the electro-coagulation printing method is composed of relatively rigid and simple parts. Thus, the printer can be operated at high speed. The upper limit of the printing speed depends on the information transmission speed of the computer rather than the printer. With a conventional computer, the printing speed on the order of several hundred meters per minute can be satisfactorily accomplished.

The coloring agents used in the electro-coagulation printing method may be the same as those used for inks in the conventional printing methods. The shape and size of the coagulated colloid in the electro-coagulation printing method are almost the same as those of the negative electrodes. In the electro-coagulation printing method, a so-called "dot gain" phenomenon does not take place on the record sheet. Thus, an image can be clearly reproduced with fine and sharp dots.

As described above, it is considered that the electro-coagulation printing method is an excellent printing method featuring high through-put and high picture quality available in the conventional printing methods. In addition, the electro-coagulation printing method has also features which are small lot printing and page variable that not available by the conventional printing methods.

As described above, since the electro-coagulation printing method is very excellent, when a normal record sheet is used, the characteristics of this method can be fully obtained. When a normal print sheet is used, the transfer rate of coagulated colloid is low. When an image with multiple colors is printed, as the number of colors increases, the transfer rate decreases. Thus, sheets suitable for magazines, posters, direct mail, fliers, and various publications, in particular, business form sheets and newspaper sheets which can be properly printed according to the electro-coagulation printing method have been desired.

SUMMARY OF THE INVENTION

The present invention is contemplated to provide an improved record media for the electro-coagulation printing. Intensively evaluated results conducted by the inventors of the present invention show that record sheets with particular characteristics can solve the above described problem.

The present invention is a record sheet used in an electro-coagulation printing method of which the wet time obtained from a liquid absorption curve of pure water measured by a dynamic scanning absorptometer is 15 milliseconds or less.

The record sheet according to the present invention can be in any form such as paper, film, or nonwoven fabric. The record sheet is suitable for any form such as magazines, posters, direct mail, fliers, and various publications, in particular, business form sheets, newspaper sheets, OCR sheets, MICR sheets, label sheets and map sheets, which are printed by a printer according to the electro-coagulation printing method. The present invention is also advantageously applicable to a kind of sheets used for a card so called "covered-up card". The covered-up card comprises a sheet of which surface is covered with a cover such as label and the like to hide characters form on the surface. The cover sheet is adhered to the sheet by a cold-type adhesive which generates adhesive property when compressed under a high pressure between metal rolls, so that the cover can be removed from the surface of the sheet, but cannot be attached again to the surface in a usual manner.

In this specification, the term "paper" is used to mean a sheet-like material composed of, for example, wood fibers beaten by a known beater, non-wood fiber, or sheet shaped substance of which a material of a solution of a filler and a particular chemical is formed by a known paper machine such as Fourdrinier paper machine, cylinder paper machine, inclined paper machine or twin-wire paper machine.

Similarly, the term "film" means a sheet shaped material of which an organic resin such as viscose, acetate, polyethylene, polypropylene, poly(vinyl chloride), polystyrene, nylon, polyacetal, polycarbonate, or polyethylene terephthalate is mixed with another filler or chemical when necessary and layered by a known method such as the melt extrusion method, the calender method, the stretching method, or the solution casting method. The film according to the present invention includes polymer paper.

The nonwoven fabric is a sheet shaped substance made of a fiber material such as wood fiber, cotton, rayon, polyethylene terephthalate, acrylic resin, acetate, nylon, or polypropylene by a known method such as the span bond method, and the paper making method, or dry method using a card machine or a garnet machine.

The sheet shaped material may be composed of a single layer. Alternatively, the sheet shaped material may also have a coat layer formed on the surface of the sheet. The coat layer is composed of a filler and a binder.

These and other objects, features and advantages of the present invention will become more apparent in light of the following detailed description of best mode embodiments thereof, as illustrated in the accompanying drawings.

DETAILED DESCRIPTION

In the present invention, the wet time obtained from liquid absorption curve of pure water measured by a dynamic scanning absorptometer is a very important factor. In addition, the absorption coefficient obtained from the liquid absorption curve and the contact ratio measured by a specular reflection smoothness tester under the pressure of 40 $kg/cm^2$ with a ray of 0.5 $\mu$m are also important factors. The characteristics of the record sheet also vary depending on the required quality of prints.

When a print requires the quality of letters and a not-fine monochrome image, the wet time obtained from the liquid absorption curve of pure water measured by the dynamic scanning absorptometer should be 15 milliseconds or less. When a print requires the quality of a fine monochrome image, the wet time and absorption coefficient obtained from the liquid absorption curve of pure water measured by the dynamic scanning absorptometer are preferably 15 milliseconds or less and 5 $ml/m^2\ s^{-1/2}$ or more, respectively.

When a print which requires the quality of a full-color image, the contact ratio measured by the specular reflection smoothness tester under the pressure of 40 kg/cm2 with a ray having a wavelength of 0.5 $\mu$m, the wet time and absorption coefficient obtained from the liquid absorption curve of pure water measured by the dynamic scanning absorptometer are preferably 40% or more, 15 milliseconds or less, and 10 $ml/m^2\ s^{-1/2}$ or more, respectively.

Figure 1:
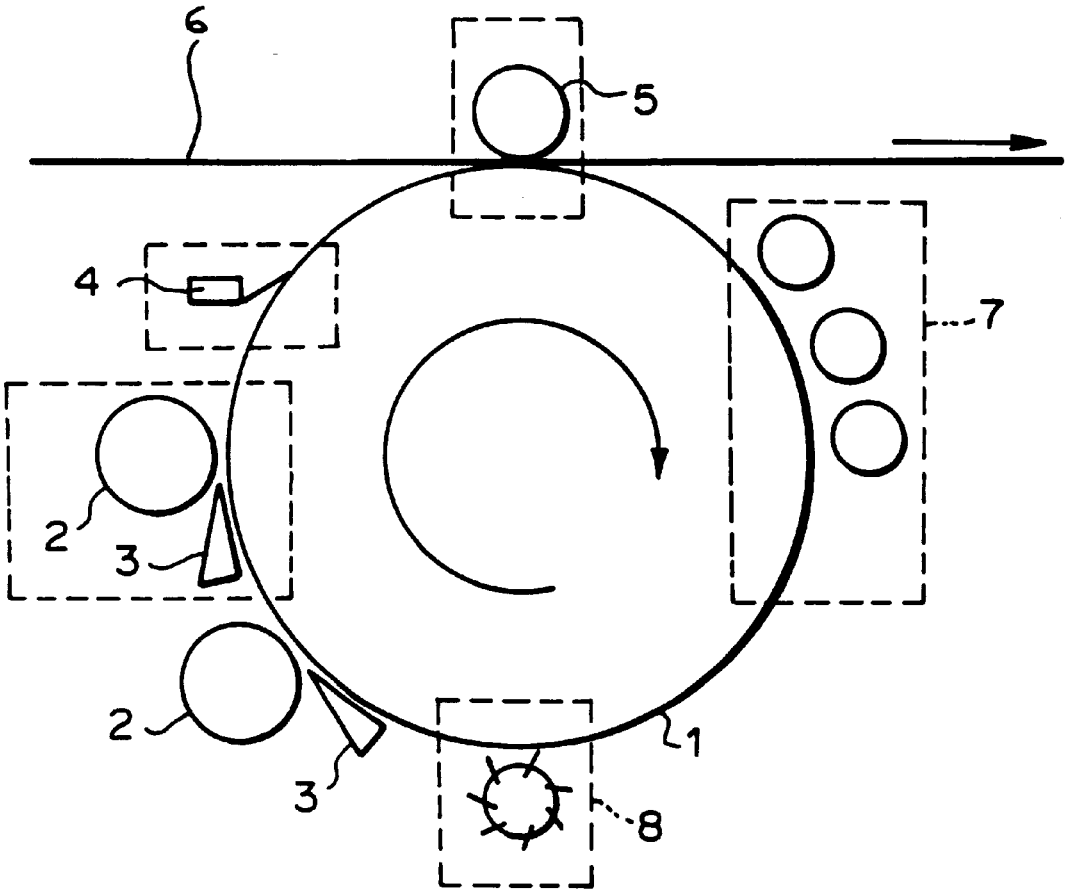
FIG. 1 is a sectional view showing a structure of principal portions of a printer according to an electro-coagulation printing method for a record sheet according to the present invention.
Figure 2:
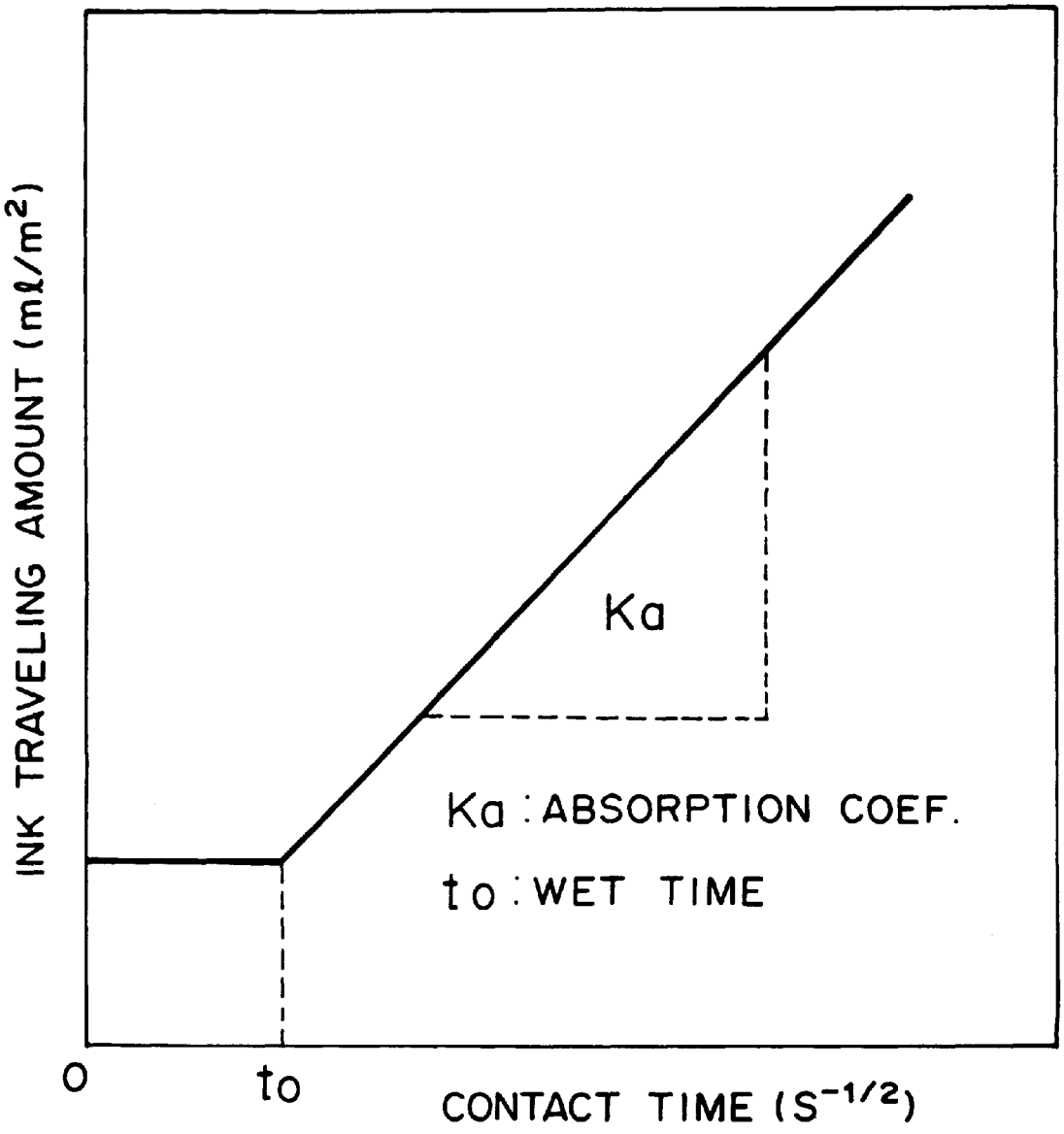
FIG. 2 is a graph showing the amount of liquid absorption measured by a dynamic scanning absorptometer and a liquid absorption curve obtained with traveling speed data of the record data.

The liquid absorption curve is obtained from the amount 25 of liquid absorption measured by a conventional dynamic scanning absorptometer and the traveling speed of the record sheet. Next, the liquid absorption curve will be described with reference to FIG. 2. The coordinate of the graph shown in FIG. 2 represents a liquid traveling amount ($ml/m^2$) obtained by dividing the liquid absorption amount (ml) by the sectional area (m2 ) of the pipe of a supply head through which the liquid flows. The abscissa of the graph in FIG. 2 represents the square root of the contact time (s) in the unit of $s^{-1/2}$. The contact time is obtained by dividing the diameter (m) of the pipe of the supply head in which the liquid flows by the traveling speed (m/s) of the record sheet.

Data measured by the dynamic scanning absorptometer is shown in FIG. 2, wherein $t_0$ is hereinafter referred to as a "wet time" and $K_a$ is an "absorption coefficient". The wet time $t_0$ is the time period until which the liquid starts permeating into the sheet, and is obtained by squaring the contact time read from the graph. The absorption coefficient $K_a$ is a coefficient of the speed at which the liquid permeates into the sheet.

Next, the electro-coagulation printing method for the record sheet according to the present invention will be described.

In the above-described printer according to the electro-coagulation printing method, although the coagulated colloid formed between the electrodes contains moisture of 25 to 65%, the viscosity and elasticity thereof are higher than those of conventional offset inks. Thus, the coagulated colloid is frailer or weaker than the conventional offset inks. In this state, the transfer characteristic of the coagulated colloid is very low.

Evaluated results conducted by the inventors of the present invention show that when the moisture of the coagulated colloid is absorbed into the record sheet, the transfer characteristic is remarkably improved. It is believed that the above results be caused singly or in complex factors that the change of moisture contained in the coagulated colloid causes the tacking ability thereof to improve, that the wetability is changed, and that the surface of the record sheet is soften.

In this recording method, since the coagulated colloid which adheres to the metal surface as the positive electrode is transferred to the record sheet, the record sheet is contacted to the electrode surface and the rear surface of the record sheet is pressed by a press roll so as to transfer the coagulated colloid to the record sheet. This method is referred to as a "contact transfer method". However, the time period during which the record sheet contacts the coagulated colloid is very short. In such a short time, moisture of the coagulated colloid should be absorbed into the record sheet. In addition, the coagulated colloid should be transferred from the positive electrode to the record sheet. In other words, the time for which the record sheet absorbs moisture of the coagulated colloid is very short. Thus, it is clear that the moisture absorption performance of very short time is a very important factor to solve the above-described problem.

The inventors have made clear that the time for which the record sheet contacts the coagulated colloid should be 20 milliseconds or less and the amount of moisture absorbed from the coagulated colloid by the record sheet should be 1 $g/m^2$ per color at maximum.

The record sheet according to the present invention comprises a sheet shaped material with a thickness in the range from 40 $\mu$m to 300 $\mu$m. Examples of the material of the record sheet are paper, film, polymer paper, and nonwoven fabric.

The transfer rate is represented by the number of drops of coagulated colloid which are transferred to the record sheet at a nip pressure of 30 kg/cm in the case that a total of 100 drops of the coagulated colloid with a diameter of 1 mm are equally arranged in a square of 10 cm×10 cm.

Generally, as a test method for measuring the dynamic liquid absorbency, the Bristow's method (Japan Tappi No. 51-87) is well known. However, this method includes various problems that the measuring accuracy for the track length is not high, that the sample amount necessary for the measurement is large, and that the time for obtaining the liquid absorption curve is long. In particular, the measurement accuracy is one of the most important problems. Evaluated results conducted by the inventors of the present invention show that the Bristow's method is not suitable for determining the characteristics of the problem.

The results obtained from the test of various testers conducted by the inventors of the present invention show that, to determine the characteristics of the record sheet according to the present invention, data measured by the dynamic scanning absorptometer is most accurate. Thus, the inventors of the present invention determined that the liquid absorption curve measured by the dynamic scanning absorptometer is used as the reference of the liquid absorbency evaluation.

The details of the dynamic scanning absorptometer will be described below. The absorptometer has an appearance similar to a conventional record player, and uses a turn table instead of a drum of the conventional Bristow's method. In addition, the absorptometer has an armed liquid supply head in the form of a pickup of the record player instead of a liquid supply pot. A record sheet to be tested is disposed on the turn table. The arm is slid on the record sheet in synchronization with the rotation of the turn table. Thus, the liquid is supplied from the supply head in a spiral shape. In addition, the liquid absorption amount is accurately and automatically measured by a meniscus connected to the supply head. The operations of the turn table and the arm are controlled by a computer, and the turn table and the arm are accelerated corresponding to a predetermine pattern, so that data on the order of 2 msec to 10 sec of the contact time can be obtained according to the liquid absorption amount and the traveling speed of the record sheet. The data shown in this specification was measured by the "KM350-D1" type dynamic scanning absorptometer produced and distributed by Kyowa Seiko Co., Ltd.

In the present invention, the smoothness under pressure is also an important factor. The record sheet is contacted with the coagulated colloid under pressure. When the smoothness under pressure is high, the contact area with the coagulated colloid becomes large. When the contact area is large, the liquid absorption performance becomes high. In addition, the adhering force with the coagulated colloid becomes strong. Thus, the probability of which the adhering force becomes stronger than the adhering force between the coagulated colloid and the positive electrode increases.

The inventors of the present invention evaluated various smoothness testers. Evaluated results show that a specular reflection smoothness tester can be effectively used in the present invention. The specular reflection smoothness tester is a device for optically measuring the smoothness under pressure as with a Chapman smoothness tester. In the specular reflection smoothness tester, a glass surface and a sample surface are contacted under pressure. The smoothness of the sample under pressure is measured with the amount of specular reflection light radiated from the glass side at a predetermined angle. The predetermined angle in this case is more than or equal to the critical angle of the interface of the glass and the sample and more than or equal to the critical angle of the interface of the glass and air. The amount of specular reflection light in the range of the angles is reversely proportional to the contact ratio of the glass surface and the sample surface. With the obtained specular reflection amount and the specular reflection amount at a contact ratio of 0%, the contact ratio of the glass surface and the sample surface, namely the smoothness of the sample under pressure, can be measured.

The measurement theory of this method is the same as that of the Chapman type. In the Chapman type, since the measured wavelength is not considered, it is not a satisfactory method. In other words, even if the sample is not contacted with the glass surface, when they approaches on the order of a wavelength, the sample penetrates through the air layer. The Chapman type does not consider this phenomenon, whereas the specular reflection smoothness tester can select a wavelength. The inventors of the present invention selected a wavelength of 0.5 $\mu$m and performs various evaluations with many samples.

The results of experiments using the dynamic scanning absorptometer and the specular reflection smoothness tester conducted by the inventors show that the wet time of a record sheet which requires the quality of characters and a not-fine monochrome image is 15 milliseconds or less, preferably, in the range from 7 to 10 milliseconds, the wet time being obtained from the liquid absorption curve of pure water measured by the dynamic scanning absorptometer.

When the wet time of a record sheet is 15 milliseconds or more, the liquid is not absorbed into the record sheet while it is being placed between the press roll and the positive electrode. Even if the liquid is absorbed, it is not sufficient. Thus, the transfer characteristic of the coagulated colloid to the record sheet is not improved.

For a record sheet which requires the quality of a fine monochrome image, the wet time obtained from the liquid absorption curve of pure water measured by the dynamic scanning absorptometer is preferably 15 milliseconds or less and the absorption coefficient obtained from the liquid absorption curve of pure water measured by the dynamic scanning absorptometer is 5 $ml/m^2\ s^{-1/2}$ or more, preferably, in the range from 8 to 15 $ml/m^2\ s^{-1/2}$.

Since the record sheet which satisfies the above-described the condition of the wet time and also the condition of the transfer rate of 80% of the coagulated colloid, such record sheet can be satisfactorily used as a print which requires the quality of letters and a not-fine monochrome image.

In contrast, for a print which requires the quality of a fine monochrome image and a print which requires the quality of a full-color image, the minimum quality cannot be attained unless the transfer rate exceeds 90%.

However, for a print which requires the quality of a fine monochrome image, the minimum quality cannot be attained with only the above-described condition. To improve the transfer rate of the coagulated colloid, a more rapid and large liquid absorption performance is required. Thus, as the characteristics of the record sheet, in addition to short wet time, high liquid absorbing speed is required. When the wet time and the absorption coefficient obtained from the liquid absorption curve of pure water by the dynamic scanning absorptometer are 15 milliseconds or less and 5 $ml/m^2\ s^{-1/2}$ or more, respectively, the transfer ratio of the coagulated colloid exceeds 90%.

For a print which requires the quality of a full-color image, another condition is applied unlike with the condition of a monochrome image. Since the liquid absorption performance of the coagulated colloid transferred to the record sheet is inferior to that of the record sheet, when coagulated colloids overlay on the record sheet, the record sheet should have quick and high liquid absorption performance and the adhering force of the record sheet and the coagulated colloid should be large. Thus, the conditions of which the transfer ratio of the second color formed on the first color exceeds 90% are that the contact ratio measured by the specular reflection smoothness tester under a pressure of 40 $kg/cm^2$ with a ray having a wavelength of 0.5 $\mu$m is 40% or more and that the wet time and the absorption coefficient obtained from the liquid absorption curve of pure water measured by the dynamic scanning absorptometer are 15 milliseconds or less and 10 $ml/m^2\ s^{-1/2}$ or more, respectively.

In other words, for a record sheet which requires the quality of a full-color image, it is preferred that the contact ratio measured by the specular reflection smoothness tester under a pressure of 40 $kg/cm^2$ with a ray having a wavelength of 0.5 $\mu$m is 40% or more, more preferably in the range from 45 to 53% and that the wet time and the absorption coefficient obtained from the liquid absorption curve of pure water by the dynamic scanning liquid absorption coefficient are 15 milliseconds or less and 10 $ml/m^2\ s^{-1/2}$ or more, respectively.

In the case that a record sheet such, for example, as paper, which is inherently liquid absorbent, it is possible to satisfy the above-described conditions by incorporating liquid absorbing filler in the body of the sheet. However, when a record sheet which basically does not have a liquid absorbency, for example, a film is provided with the liquid absorbency, a coat layer is normally deposited on the front surface of the record sheet. In addition, when a coat layer is formed on the front surface of a record sheet which has the liquid absorbency, it functions as a very good means for improving the printing quality. In particular, when a full-color image is printed, since the luster and white color degree are also very important factors as the printing quality, in the known printing methods, a full-color image is normally printed on a print sheet with a coat layer.

The inventors has evaluated a coat layer suitable for full-color images corresponding to the electro-coagulation printing method. Thus, a coat layer which satisfies the following conditions at the same time:

1. The contact ratio measured by the specular reflection smoothness tester under a pressure of 40 $g/cm^2$ with a ray having a wavelength of 0.5 $\mu$m is 40% or more;
2. the wet time obtained from the liquid absorption curve of pure water measured by the dynamic scanning absorptometer is 15 milliseconds or less; and
3. the absorption coefficient obtained from the liquid absorption curve of pure water measured by the dynamic scanning absorptometer is 10 $ml/m^2\ s^{-1/2}$ or more;

then the evaluated results show the following facts:

1. when the average specific surface area of all fillers in the coat layer in the Brunaver, Emmett, Teller (BET) method is 10 $m^2/g$ or less or the average oil absorption of all the fillers is 40 ml/100 g or less, the record sheet does not satisfy the above described conditions for a full-color image and thereby the transfer ratio of the coagulated colloid of the second and later colors becomes 90% or less; and
2. when the total amount of all binders in the coat layer is 20 parts by weight or less to 100 parts by weight of the amount of all the fillers in the coat layer, the strength of the coat layer is insufficient. Thus, a trouble such as a breakage of the coat layer takes place when the coagulated colloid is contacted and transferred to the print sheet. When the amount of all the binders in the coat layer is 60 parts by weight or more to 100 parts by weight of the amount of all the binders in the coat layer, the transfer ratio of the coagulated colloid of the second and later colors becomes 90% or less.

An inorganic filler such as clay, kaolin, soft calcium carbide, hard calcium carbide, titanium dioxide, synthetic amorphous silica, silica sol, colloidal silica, satin white, diatomaceous earth, aluminum silicate, calcium silicate, alumina sol, colloidal alumina, boehmite or pseudo boehmite, or an organic filler such as polypropylene, polyethylene terephthalate (PET), or acrylic resin may be used as a single filler or as a mixture thereof. Among them, due to high liquid absorption performance, synthetic amorphous silica, silica sol, colloidal silica, alumina sol, colloidal alumina, boehmite, or pseudo boehmite is preferably used.

In case of paper, such a filler can be contained therein. In this case, synthetic amorphous silica, silica sol, colloidal silica, alumina sol, colloidal alumina, boehmite, pseudo boehmite is preferably used.

In case that the base sheet is a film, a card, or emboss paper, to fulfill the transparency, colors, and texture, the coat layer is preferably transparent. To allow the coat layer with the liquid absorbency to have also the transparency, the diameter of pores should be less than the half of the wavelength of the visible light. Since the diameter of pores of the coat layer mainly depends on the diameters of particles of the filler for use, when a very fine filler is used, the liquid absorbency and the transparency can be satisfied at the same time. Examples of the preferable very fine filler may includes colloidal silica, colloidal alumina, boehmite, and pseudo boehmite.

Examples of the binder are polyvinyl alcohol, a denatured substance thereof, starch, a denatured substance thereof, casein, NR, SBR, NBR, acrylic resin, polyvinyl pyrrolidone, a mixture thereof, or a copolymer thereof.

When a substance which represents the characteristics of cation is contained in the record sheet according to the present invention, since the water resisting characteristic of the coagulated colloid which has been transferred can be improved. Thus, this method is an effective means for the record sheet whose print surface requires the water resisting characteristic. Examples of the substance which represents the characteristics of cation include organic particles such as alumina sol, colloidal alumina, boehmite, and pseudo boehmite, water soluble salts of metals such as aluminum, iron, manganese, magnesium, and calcium, polyvinyl pyridium bromide, dimethyl allyl ammonium chloride, poly (ethyleneimine amido) ammonium salt condensation product, cationic colloidal silica, polyalkylene poly(amine dicyanadiamido) ammonium salt condensation product, quaternary ammonium salt polyelectrolyte, dialkanol amino modified alkyleneglycol derivatives, acrylamide diallyl dimethyl ammoniumchloride copolymer, and cationic resin reacted with secondary amide and epihalohydrine. In the present invention, one of these substances or a mixture thereof can be used.

The substance which represents the characteristics of cation can be used in one of the following manners. The substance may be coated on the front surface of the sheet as it is. The substance may be contained in the sheet when it is formed. Alternatively, the substance may be added in a coat layer. Even if a small amount of such a substance is contained in the sheet contacted with the coagulated colloid, the effect thereof can be obtained.

When the substance is coated, a known coating means such as air knife coater, gravure coater, blade coater, roll coater, gate roll coater, or bar coater may be properly used.

As business form sheets, there are mail form sheets (postcard form sheets and envelop form sheets), label form sheets, bank transfer form sheets, and computer form sheets. These form sheets are commonly printed by the electrophotographic method and ink jet method. In particular, from view points of high through-put, high picture quality, small lot printing, and page variable characteristic, it is considered that the electro-coagulation printing method is most suitable for printing of business form sheets.

The business form sheets according to the present invention are not limited as long as they are suitable for the electro-coagulation printing method. Print sheets and information sheets can be properly used.

Newspaper sheets are mainly printed by the offset printing method due to requirements of high speed, color printing, and many types of newspaper. In this situation, it is considered that the electro-coagulation printing method satisfies such requirements. In addition, since the electro-coagulation printing method can satisfy the requirements of many types of printing and small lot printing, this method has advantages that are not available in the offset printing method.

The material of newspaper sheets according to the present invention is deinked pulp, ground pulp, thermo-mechanical pulp, or kraft pulp or a mixture thereof at a predetermined ratio with a weighing capacity of 41 g/m$^2$ to 49 g/m$^2$. When necessary, a filler such as white carbon, clay, silica, talc, titanium oxide, calcium carbonate, or synthetic resin can be properly added. Alternatively, a paper strength agent such as polyacrylamide type polymer, poly(vinyl alcohol) type polymer, starch, or urea-formalin resin may be properly added. In addition, yield improving agent, rosin size agent, synthetic size agent, water resisting agent, discoloration resisting agent, and/or ultraviolet ray resisting agent may be properly added. Moreover, a surface treatment agent may be properly added so as to improve the paper strength and printing adaptivity, prevent sticking, and enhance the surface strength.

As described above, the electro-coagulation printing method provides not only high through-put and high picture quality which are available in the conventional printing methods, but small lot printing and page variable characteristic which are not available in the conventional printing methods.

The present invention will be clearly understood from the following specific Examples.

EXAMPLES (Preparation of Paper Material A)

20 parts by weight of breached needle-leaved tree kraft pulp (NBKP) and 80 parts by weight of breached broad-leaf tree kraft pulp (LBKP) were beaten to become 500 ml C.S.F., and then mixed with 10 parts by weight of clay, 0.3 part by weight of paper strength agent (trade name "POLYSTRON 191," Arakawa chemical industries, Ltd.), 0.3 part by weight of size agent (trade name "SIZEPINE E," Arakawa Chemical Industries, Ltd.), and 2.0 parts by weight of Alum. With the resultant material, a paper material A with a weighing capacity of 100 g/m2 was fabricated by a Fourdrinier paper machine in the conventional manner.

(Preparation of Paper Material B)

20 parts by weight of NBKP and 80 parts by weight of LBKP were beaten to become 350 ml C.S.F. To the resultant material were added 10 parts by weight of clay, 0.3 part by weight of paper strength agent (ditto), 2.0 parts by weight of size agent (ditto), and 2.0 parts by weight of Alum. With the resultant material, a paper material B with a weighing capacity of 100 g/m$^2$ was fabricated by the Fourdrinier paper machine in the conventional manner.

(Preparation of Paper Material C)

20 parts by weight of NBKP and 80 parts by weight of LBKP were beaten to become 500 ml C.S.F. The resultant material was mixed with 20 parts by weight of synthetic amorphous silica (trade name "TOKUSIL-P," Tokuyama Corporation), 0.3 part by weight of paper strength agent (trade name "POLYSTRON 191," Arakawa Chemical Industries, Ltd.), 0.3 part by weight of size agent ("SIZEPINE E," Arakawa Chemical Industries, Ltd.), and 2.0 parts by weight of Alum. With the resultant material, a paper material C with a weighing capacity of 100 g/m$^2$ was fabricated by the Fourdrinier paper machine in the conventional manner.

Example 1

The paper material A was used as it was.

Example 2

The paper material C was used as it was.

Example 3

100 parts by weight of synthetic amorphous silica (trade name "FINESIL-X37B," Tokuyama Corporation) and 20 parts by weight of polyvinyl alcohol (trade name "KURALAY POVAL PVA-110," Kuraray Company Limited) were mixed with 500 parts by weight of water. The resultant solution with a coat amount of 5 g/m$^2$ was coated on the front surface of the paper material B by an air knife coater.

Example 4

100 parts by weight of synthetic amorphous silica and 60 parts by weight of polyvinyl alcohol as used in Example 3 were mixed with 500 parts by weight of water. The resultant solution with a coat amount of 5 g/m$^2$ was coated on the front surface of the paper material B by a blade coater.

Example 5

100 parts by weight of synthetic amorphous silica (ditto), 60 parts by weight of polyvinyl alcohol (ditto), and 0.1 part by weight of aluminum sulfate were mixed with 500 parts by weight of water. The resultant solution with a coat amount of 5 g/m$^2$ was coated on the front surface of the paper material B by a roll coater.

Example 6

When the paper material A was fabricated, a solution of which 1 weight part of dimethyl allyl ammonium chloride (trade name "PAS-H10," Nitto Boseki Co., Ltd.) was solved with 100 parts by weight of water was coated by a size press part.

Example 7

40 parts by weight (solid portion) of silica sol (trade name "SNOWTEX OUP," Nissan Chemical Industries, LTD.) and 10 parts by weight of polyvinyl alcohol (ditto) were dispersed in 450 parts by weight of water. The resultant solution with a coat amount of 5 g/m$^2$ was coated on the front surface of drawn polyethylene terephthalate film (Toray Co., Ltd.) by the air knife coater.

Example 8

40 parts by weight (solid portion) of alumina sol (trade name "ALUMINASOL-100," Nissan Chemical Industries, LTD.) and 10 parts by weight of polyvinyl alcohol (ditto) were dispersed in 450 parts by weight of water. The resultant solution with a coat amount of 5 g/m$^2$ was coated on the front surface of drawn polyethylene terephthalate film (ditto) by the air knife coater.

Example 9

40 parts by weight (solid portion) of colloidal silica (trade name "SNOWTEX-O," Nissan Chemical Industries, LTD.) and 10 parts by weight of polyvinyl alcohol (ditto) were dispersed in 450 parts by weight of water. The resultant solution with a coat amount of 5 g/m$^2$ was coated on the front surface of drawn polyethylene terephthalate film (ditto) by the air knife coater.

Example 10

40 parts by weight (solid portion) of pseudo boehmite (produced by heating alumina sol sold under the trade name "ALUMINASOL-100" (Nissan Chemical Industries, LTD.)) and 10 parts by weight of polyvinyl alcohol (ditto) were dispersed in 450 parts by weight of water. The resultant solution with a coat amount of 5 g/m2 was coated on the front surface of drawn polyethylene terephthalate film (ditto) by the air knife coater.

Comparative Example 1

The paper material B was used as it was.

The contact ratio under a pressure of 40 kg/cm$^2$ and the wet time and absorption coefficient were measured by the specular reflection smoothness tester and the dynamic scanning absorptometer for the samples according to Examples 1 to 10 and Comparative Example 1. In addition, the transfer ratio of the first color and the transfer ratio of the second color after solid-printing of the first color by an electrocoagulation printer (ELCORSY Co.) were evaluated. Moreover, the water resisting characteristic and the haze value of each sample were measured. These measured values are listed in Table 1.

TABLE 1

| Examples | Wet time (msec) | Absorption coeff. (ml/m$^2$s$^{-1/2}$) | Contact ratio (%) | 1st color trans. (%) | 2nd color trans. (%) | Water resisting charac. | Haze (%) |
|---|---|---|---|---|---|---|---|
| Example 1 | 13 | 3 | 6 | 86 | 5 | × | — |
| Example 2 | 11 | 6 | 6 | 95 | 13 | × | — |
| Example 3 | 7 | 15 | 45 | 100 | 100 | × | — |
| Example 4 | 7 | 12 | 45 | 100 | 98 | × | — |
| Example 5 | 7 | 12 | 45 | 100 | 98 | ○ | — |
| Example 6 | 15 | 3 | 6 | 85 | 5 | ○ | — |
| Example 7 | 9 | 14 | 48 | 100 | 100 | × | 36.2 |
| Example 8 | 10 | 13 | 49 | 100 | 100 | ○ | 24.3 |
| Example 9 | 9 | 14 | 52 | 100 | 100 | × | 12.0 |
| Example 10 | 8 | 15 | 53 | 100 | 100 | ○ | 9.5 |
| Comparative Example 1 | 17 | 3 | 4 | 40 | 3 | × | — |

The results in Table 1 show the facts that follow.

1) As is clear from the comparison between Example 1 and Comparative Example 1, when the wet time exceeds 15 milliseconds, the transfer rate of the coagulated colloid remarkably deteriorates.

2) As is clear from the comparison between Example 1 and 2, when the wet time is 15 milliseconds or less, the transfer ratio of the coagulated colloid of the first color is 80% or more. In addition, when the absorption coefficient is 5 $ml/m^2 s^{-1/2}$ or more, the transfer rate becomes 90% or more.

3) As is clear from Example 3, when the contact ratio is 40% or more, the wet time is 15 milliseconds or less, and the absorption coefficient is 10 $ml/m^2 s^{-1/2}$ or more, the transfer ratio of the second color exceeds 90%.

4) As is clear from the comparison between Example 3 and Example 4, when the amount of the binder of the coat layer is in the range from 20 to 60 weight part, the average specific surface area of the filler of the coat layer is 10 $m^2/g$ or more, and the average oil absorption is 40 ml/100 g or more, the transfer ratio of the second color exceeds 90%.

For the samples according to Examples 4 and 5 as well as Examples 1 and 6, the water resisting characteristics of the printed images were also evaluated in such a manner that the individual samples were submerged in water for five minutes and the printed surfaces were rubbed by fingers.

The deterioration of the strength of the print surface after the submersion of the sample according to Example 5, in which aluminum sulfate was added to the coat solution, was lower than that of the sample according to Example 4, in which aluminum sulfate was not added to the coat solution. The sample according to Example 6, in which dimethyl allyl ammonium chloride was coated by the size press, had the similar effect in comparison with the sample according to Example 1, in which dimethyl allyl ammonium chloride was not coated. In other words, the results of experiments show that the addition of a substance which represents the characteristics of cation contributes to improving the water resisting characteristic of the coagulated colloid. Moreover, the samples according to Examples 8–10, in which coat layers composed of alumina sol or pseudo boehmite showed good results.

The samples according to Examples 9 and 10 were transparent record sheets with haze values ranging from 9.5 to 12.0%.

(Preparation of Paper Material D)

35 parts by weight of deinked old newspaper pulp, 30 parts by weight of thermomechanical pulp (TMP), 20 parts by weight of ground pulp (GP), and 15 parts by weight of preached needle-leaved kraft pulp (NBKP) were mixed and beaten to become 200 ml C.S.F. With the resultant pulp slurry, a newspaper material D with a weighing capacity of 43 $g/m^2$ was fabricated.

Example 11

A solution of polyvinyl alcohol with a coat amount of 0.5 $g/m^2$ was coated on both the surfaces of the paper material D by a gate roll coater.

Example 12

A solution of cationic starch with a coat amount of 0.5 $g/m^2$ was coated on both the surfaces of the paper material D by the gate roll coater.

Example 13

40 parts by weight (solid portion) of alumina sol (trade name "ALUMINASOL-100," Nissan Chemical Industries, LTD.) and 10 parts by weight of polyvinyl alcohol (ditto) were dispersed in 450 parts by weight of water. The resultant solution with a coat amount of 0.5 $g/m^2$ was coated on both the surfaces of the paper material D by the gate roll coater.

Example 14

40 parts by weight (solid portion) of colloidal silica (trade name "SNOWTEX-O," Nissan Chemical Industries, LTD.) and 10 parts by weight of polyvinyl alcohol (ditto) were dispersed in 450 parts by weight of water. The resultant solution with a coat amount of 0.5 $g/m^2$ was coated on both the surfaces of the paper material D by the gate roll coater.

Example 15

35 parts by weight of DIP, 30 parts by weight of TMP, 20 parts by weight of GP, and 15 parts by weight of NBKP were mixed and beaten to become 200 ml C.S.F. The resultant material was mixed with 20 parts by weight of synthetic amorphous silica (trade name "TOKUSIL-P," Tokuyama Corporation), paper strength agent (trade name "POLYSTRON 191," Arakawa Chemical Industries, Ltd.), 0.3 part by weight of size agent (trade name "SIZEPINE E," Arakawa Chemical Industries, Ltd.) and 2.0 parts by weight of Alum. With the resultant material, a newspaper material with a weighing capacity of 43 $g/m^2$ was fabricated by Bel-Baie former.

(Preparation of Paper Material E)

25 parts by weight of breached needle-leaved tree kraft pulp (NBKP), 75 parts by weight of broad-leaf tree kraft pulp (LBKP) were beaten to become 400 ml C.S.F. The resultant pulp was added with 8.5% by weight of talc and 1.5% by weight of titanium dioxide as fillers. In addition, the resultant pulp was added with 0.6% by weight of rosin size agent and 2% by weight of band. With the resultant material, a paper material E with a weighing capacity of 70 $g/m^2$ was fabricated by the Fourdrinier paper machine.

Example 16

100 parts by weight of synthetic amorphous silica (trade name "FINESIL-X37B," Tokuyama Corporation) and 20 parts by weight of polyvinyl alcohol (trade name "KURALAY POVAL PVA-110," Kuraray Company Limited) were mixed with 500 parts by weight of water. The resultant coat solution with a coat amount of 5 $g/m^2$ was coated on both the surfaces of the paper material E by the air knife coater.

Example 17

40 parts by weight (solid portion) of boehmite (trade name "ALUMINASOL-500," Nissan Chemical Industries, LTD.) and 10 parts by weight of polyvinyl alcohol (ditto) were dispersed in 450 parts by weight of water. The resultant solution with a coat amount of 5 $g/m^2$ was coated on both the front surfaces of the paper material E by the air knife coater.

Example 18

40 parts by weight (solid portion) of colloidal silica (trade name "SNOWTEXT O," Nissan Chemical Industries, LTD.) and 10 parts by weight of polyvinyl alcohol (ditto) were dispersed in 450 parts by weight of water. The resultant solution with a coat amount of 5 $g/m^2$ was coated on both the surfaces of the paper material E by the air knife coater.

Example 19

25 parts by weight of NBIP and 75 parts by weight of LBKP were beaten to become 400 ml C.S.F. The resultant material was mixed with 4% by weight of synthetic amorphous silica (trade name "FIBERSIL-X37B," Tokuyama Corporation) 4.5% by weight of talc, 1.5% by weight of titanium dioxide, 0.6% by weight of rosin size agent, and 2% by weight of band. With the resultant material, a business form sheet with a weighing capacity of 70 g/m$^2$ was fabricated by the Fourdrinier paper machine.

Comparative Example 2

The paper material E was used as it was.

For the samples according to the Examples 11–19 and Comparative Example 2, evaluated results are shown in Table 2 as with Table 1. Since each sample was transparent, the measurement for the haze value thereof was omitted.

TABLE 2

| Examples | Wet time (msec) | Absorption coeff. (ml/m$^2$s$^{-1/2}$) | Contact ratio (%) | 1st color trans. (%) | 2nd color trans. (%) | Water resisting charac. |
|---|---|---|---|---|---|---|
| Example 11 | 14 | 7 | 42 | 97 | 70 | × |
| Example 12 | 14 | 7 | 42 | 97 | 70 | × |
| Example 13 | 7 | 12 | 48 | 100 | 95 | ○ |
| Example 14 | 7 | 13 | 49 | 100 | 96 | × |
| Example 15 | 11 | 10 | 41 | 99 | 92 | × |
| Example 16 | 7 | 15 | 43 | 100 | 100 | × |
| Example 17 | 6 | 14 | 48 | 100 | 99 | ○ |
| Example 18 | 8 | 15 | 46 | 100 | 100 | × |
| Example 19 | 9 | 10 | 9 | 95 | 30 | × |
| Comparative Example 2 | 16 | 4 | 7 | 47 | 2 | — |

As the results shown in Table 2, it is clear that the Examples 13–15 satisfy the performance required for newspaper sheets used in the electro-coagulation printing method. In addition, it is clear that Examples 16 to 19 satisfy the performance required for business form sheets used in the electro-coagulation printing method.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A method for electro-coagulation printing for a record sheet comprising forming characters and images on a cylinder as a positive electrode with an ink which brings about colored-coagulated colloid with electric charge and transferring the characters and images under a pressed condition to the record sheet brought into contact with the surface of the positive electrode, wherein said record sheet has a wet time obtained from a liquid absorption curve of pure water measured by a dynamic scanning absorptometer of not more than 15 milliseconds, and contains at least one filler selected from the group consisting of clay, soft calcium carbide, hard calcium carbide, titanium dioxide, synthetic amorphous silica, silica sol, colloidal silica, satin white, diatomaceous earth, aluminum silicate, calcium silicate, alumina sol, colloidal alumina, boehmite, and pseudo boehmite.

2. A method as claimed in claim 1 wherein said record sheet has a surface to be printed composed of a coat layer comprising a filler and a binder, the ratio of the binder being 20 to 60 parts by weight to 100 parts by weight of the filler, the specific surface area in BET method of the filler being at least 10 m$^2$/g, and the oil absorption of the filler being at least 40 ml/100 g.

3. A method as claimed in claim 2 wherein the filler comprises at least one filler selected from the group consisting of clay, kaolin, soft calcium carbide, hard calcium carbide, titanium dioxide, synthetic amorphous silica, silica sol, colloidal silica, satin white, diatomaceous earth, aluminum silicate, calcium silicate, alumina sol, colloidal alumina, boehmite, and pseudo boehmite.

4. A method as claimed in claim 2 wherein the coat layer contains at least one of colloidal silica, colloidal alumina, boehmite and pseudo boehmite, the coat layer being transparent.

5. A method as claimed in claim 1 wherein said record sheet further contains a cationic material.

6. A method as claimed in claim 5 wherein the cationic material is at least one of an inorganic particle selected from the group consisting of alumina sol, colloidal alumina, boehmite, and pseudo boehmite; a water soluble salt of metals selected from the group consisting of aluminum, iron, manganese, magnesium, and calcium; and an organic substance selected from the group consisting of polyethylene imine, polyvinyl pyridium bromide, dimethyl allyl ammonium chloride, a poly(ethyleneimine amido) ammonium salt condensation product, cationic colloidal silica, polyalkylene poly(amine dicyandiamido) ammonium salt condensation product, quaternary ammonium salt polyelectrolyte, dialkanol amino modified alkyleneglycol derivative and acrylamide diallyl dimethyl ammoniumchloride copolymer; and cationic resin obtained by a reaction of secondary amide with epihalohydrine.

7. A method for electro-coagulation printing for a record sheet comprising forming characters and images on a cylinder as a positive electrode with an ink which brings about colored-coagulated colloid with electric charge and transferring the characters and images under a pressed condition to the record sheet brought into contact with the surface of the positive electrode, wherein said record sheet has (i) a wet time obtained from a liquid absorption curve of pure water measured by a dynamic scanning absorptometer of not more than 15 milliseconds; and (ii) an absorption coefficient obtained from a liquid absorption curve of pure water measured by a dynamic scanning absorptometer of at least 10 ml/m$^2$ s$^{-1/2}$ and contains at least one filler selected from the group consisting of clay, soft calcium carbide, hard calcium carbide, titanium dioxide, synthetic amorphous silica, silica sol, colloidal silica, satin white, diatomaceous earth, aluminum silicate, calcium silicate, alumina sol, colloidal alumina, boehmite, and pseudo boehmite.

8. A method as claimed in claim 7 wherein said record sheet has a surface to be printed composed of a coat layer comprising a filler and a binder, the ratio of the binder being 20 to 60 parts by weight to 100 parts by weight of the filler, the specific surface area in BET method of the filler being at least 10 $m^2/g$, and the oil absorption of the filler being at least 40 ml/100 g.

9. A method as claimed in claim 8 wherein the filler comprises at least one filler selected from the group consisting of clay, kaolin, soft calcium carbide, hard calcium carbide, titanium dioxide, synthetic amorphous silica, silica sol, colloidal silica, satin white, diatomaceous earth, aluminum silicate, calcium silicate, alumina sol, colloidal alumina, boehmite, and pseudo boehmite.

10. A method as claimed in claim 8 wherein the coat layer contains at least one of colloidal silica, colloidal alumina, boehmite and pseudo boehmite, the coat layer being transparent.

11. A method as claimed in claim 7 wherein said record sheet further contains a cationic material.

12. A method as claimed in claim 11 wherein the cationic material is at least one of an inorganic particle selected from the group consisting of alumina sol, colloidal alumina, boehmite, and pseudo boehmite; a water soluble salt of metals selected from the group consisting of aluminum, iron, manganese, magnesium, and calcium; and an organic substance selected from the group consisting of polyethylene imine, polyvinyl pyridium bromide, dimethyl allyl ammonium chloride, a poly(ethyleneimine amido) ammonium salt condensation product, cationic colloidal silica, polyalkylene poly(amine dicyandiamido) ammonium salt condensation product, quaternary ammonium salt polyelectrolyte, dialkanol amino modified alkyleneglycol derivative and acrylamide diallyl dimethyl ammoniumchloride copolymer; and cationic resin obtained by a reaction of secondary amide with epihalohydrine.

* * * * *